US005678645A

United States Patent [19]

Tibbitts et al.

[11] Patent Number: 5,678,645

[45] Date of Patent: Oct. 21, 1997

[54] MECHANICALLY LOCKED CUTTERS AND NOZZLES

[75] Inventors: Gordon A. Tibbitts, Salt Lake City, Utah; Paul E. Pastusek, The Woodlands, Tex.

[73] Assignee: Baker Hughes Incorporated, Houston, Tex.

[21] Appl. No.: 557,962

[22] Filed: Nov. 13, 1995

[51] Int. Cl.[6] ..... E21C 13/00

[52] U.S. Cl. ..... 175/426; 175/429

[58] Field of Search ..... 175/426, 429; 299/108, 113

[56] References Cited

U.S. PATENT DOCUMENTS

| | | | |
|---|---|---|---|
| 1,228,296 | 5/1917 | Chapman . | |
| 1,351,003 | 8/1920 | Pace . | |
| 1,388,490 | 8/1921 | Suman . | |
| 1,403,711 | 1/1922 | Schaefer et al. . | |
| 1,767,883 | 6/1930 | Hardscog . | |
| 1,995,043 | 3/1935 | Sanderson . | |
| 2,022,055 | 11/1935 | Sanderson . | |
| 2,022,194 | 11/1935 | Galvin . | |
| 2,121,202 | 6/1938 | Killgore . | |
| 2,595,525 | 5/1952 | Huckshold . | |
| 2,950,090 | 8/1960 | Swart . | |
| 3,101,934 | 8/1963 | Poundstone . | |
| 3,113,630 | 12/1963 | Williams . | |
| 3,139,149 | 6/1964 | Dionisotti . | |
| 3,143,177 | 8/1964 | Galorneau et al. . | |
| 3,182,736 | 5/1965 | Pitifer . | |
| 3,342,531 | 9/1967 | Krekeler . | |
| 3,382,940 | 5/1968 | Stebley . | |
| 3,389,761 | 6/1968 | Ott | 175/426 X |
| 3,415,332 | 12/1968 | Bower . | |
| 3,537,539 | 11/1970 | Adcock . | |
| 3,545,554 | 12/1970 | Bardwell . | |
| 3,563,325 | 2/1971 | Miller . | |
| 3,599,737 | 8/1971 | Fischer . | |
| 3,603,414 | 9/1971 | Stebley | 175/426 X |
| 3,618,683 | 11/1971 | Hughes . | |
| 3,693,736 | 9/1972 | Gardner | 175/426 |
| 3,717,209 | 2/1973 | Sheldon et al. . | |
| 3,734,213 | 5/1973 | Goodfellow . | |
| 3,749,190 | 7/1973 | Shipman | 175/426 |
| 3,765,496 | 10/1973 | Flores et al. . | |
| 3,771,612 | 11/1973 | Adcock | 175/426 X |
| 3,820,849 | 6/1974 | Lundstrom et al. . | |
| 3,904,247 | 9/1975 | Ostrop . | |
| 3,976,271 | 8/1976 | Larrson et al. . | |
| 4,014,395 | 3/1977 | Pearson . | |
| 4,026,605 | 5/1977 | Emmerich . | |
| 4,073,354 | 2/1978 | Rowley et al. . | |
| 4,076,318 | 2/1978 | Hauschopp et al. . | |
| 4,094,611 | 6/1978 | Harper et al. . | |

(List continued on next page.)

FOREIGN PATENT DOCUMENTS

| | | | |
|---|---|---|---|
| 0 084 418 | 1/1983 | European Pat. Off. . | |
| 0 087 283 | 2/1983 | European Pat. Off. . | |
| 0 154 422 | 2/1985 | European Pat. Off. . | |
| 0 581 534 | 7/1993 | European Pat. Off. . | |
| 844111 | 5/1958 | United Kingdom . | |
| 1112446 | 5/1968 | United Kingdom | 299/113 |
| 2115460 | 9/1983 | United Kingdom . | |

OTHER PUBLICATIONS

David Harrison, Search Report under Section 17, Appl. No. GB 96233480.2, (16 Jan. 1997).

*Primary Examiner*—William P. Neuder
*Attorney, Agent, or Firm*—Trask, Britt & Rossa

[57] ABSTRACT

Mounting apparatus is described for locking an insertable stud cutter or slug cutter or fluid nozzle into a socket on a rotatable earth boring drill bit. The cutter may be readily removed and replaced without damaging either the cutter, nozzle or bit. Apparatus are shown for permitting, or alternatively, preventing rotation of the cutter or nozzle in its socket. The mounting apparatus is particularly applicable to cutters having a cutting disk of polycrystalline diamond or other superabrasive material mounted on a carbide supporting body, or carbide body nozzles or nozzles having a bore lined with such a material.

33 Claims, 9 Drawing Sheets

U.S. PATENT DOCUMENTS 4,189,013 2/1980 Adams et al. .
4,199,035 4/1980 Thompson .
4,200,159 4/1980 Peschel et al. .
4,271,917 6/1981 Sahley .
4,298,233 11/1981 Elfgen ..... 299/108
4,334,585 6/1982 Upton .
4,351,401 9/1982 Fielder .
4,360,069 11/1982 Davis ..... 175/429 X
4,382,477 5/1983 Barr .
4,465,148 8/1984 Morris et al. .
4,466,498 8/1984 Bardwell .
4,536,037 8/1985 Rink .
4,538,690 9/1985 Short .
4,611,417 9/1986 Carlson ..... 299/108 X
4,700,790 10/1987 Shirley .
4,782,903 11/1988 Strange .
4,804,231 2/1989 Buljan et al. ..... 299/113
4,813,501 3/1989 Mills et al. .
4,877,096 10/1989 Tibbitts .

MECHANICALLY LOCKED CUTTERS AND NOZZLES

BACKGROUND OF THE INVENTION

This invention relates to rotary drill bits for use in drilling and coring deep holes in subsurface formations. More particularly, the invention pertains to apparatus and methods for mounting stud cutters on the bodies of drag bits, and may have application to cutter inserts mounted to rock bit cones, as well as to the mounting of fluid nozzles to the bodies of both types of bits.

A rotary drill bit, of the kind to which the invention relates, comprises a bit body having a shank for connection of the bit to a drill string. Typically, the bit body contains an inner passageway for introducing drilling fluid to the face of the bit. The bit body is typically formed of steel or of a metal matrix including hard, wear-resistant particles such as tungsten carbide infiltrated with a hardenable liquid binder. Mounted in receptacles within a drag bit body, are a plurality of insert stud cutters and/or slug cutters, together with nozzles for introducing drilling fluid to the cutters for cooling, lubrication and removing particles of drilled material. Similarly, cutter inserts are secured within apertures in the exteriors of the rotating cones of rock bits.

When compared with the earlier-developed conventional mill tooth rock bits, cutter inserts of tungsten carbide or diamond may have a tendency to become dislodged from their insert holes in a roller cone. Similarly, slug cutters and stud cutters may have a tendency to separate from a drag bit body. One reason for this is that the bit body or cone body cannot be hardened to the same high Rockwell hardness level as conventional mill tooth bits, because of the lower hardness required for drilling the cutter sockets or insert holes. As a result of the lower hardness of the bit body or cone body at the surface and particularly the subsurface portions thereof, erosion from the circulating mud may occur more rapidly, and eventually the cutter or insert may come loose. Thus, cutters or inserts which are conventionally brazed into socket insert holes have a relatively high frequency of loss. The cutters and inserts fall out, leaving a clean hole in the bit or cone and eventually leading to bit failure as the uncut segment of the formation previously contacted by the now-missing cutter or insert disrupts the design cutting action of the bit.

Breakage of cutters is another common problem in rock drilling, and necessitates removal and replacement of the defective cutter stud, cutter slug or insert from its socket. Such replacement is not always readily accomplished in the field with prior art insert affixation techniques, where the required specialized tools are often unavailable.

Finally, replaceable nozzles have been commercially available for many years, but state-of-the art nozzle affixation structures leave much to be desired in terms of ease of removal and placement of nozzles.

SUMMARY OF THE INVENTION

According to the invention, there is provided apparatus and methods for lockably mounting stud or slug cutters and fluid nozzles in rotary drill bits for rock and earth formations. The apparatus provides mechanical means for locking the cutter or nozzle into the bit body or cutter into the roller cone, yet permitting rapid removal when necessary to replace the cutter or nozzle. The invention provides means for either preventing or alternatively permitting rotation of the cutter or nozzle element mounted within the socket, as desired for the particular location on the drill bit and drilling conditions.

The invention may be characterized as comprising retaining structure which eliminates the need for brazing of the cutter or nozzle element into the socket in the drill bit body or roller cone. Instead, a mechanical lock of controllably uniform strength is provided which retains the cutter or nozzle element in the socket under severe drilling conditions, yet enables rapid removal and replacement when necessary.

BRIEF DESCRIPTION OF THE DRAWINGS

Reference is now made to the following Description of the Preferred Embodiments taken in conjunction with the accompanying drawings, in which.

DESCRIPTION OF THE PREFERRED EMBODIMENTS

Figure 1:
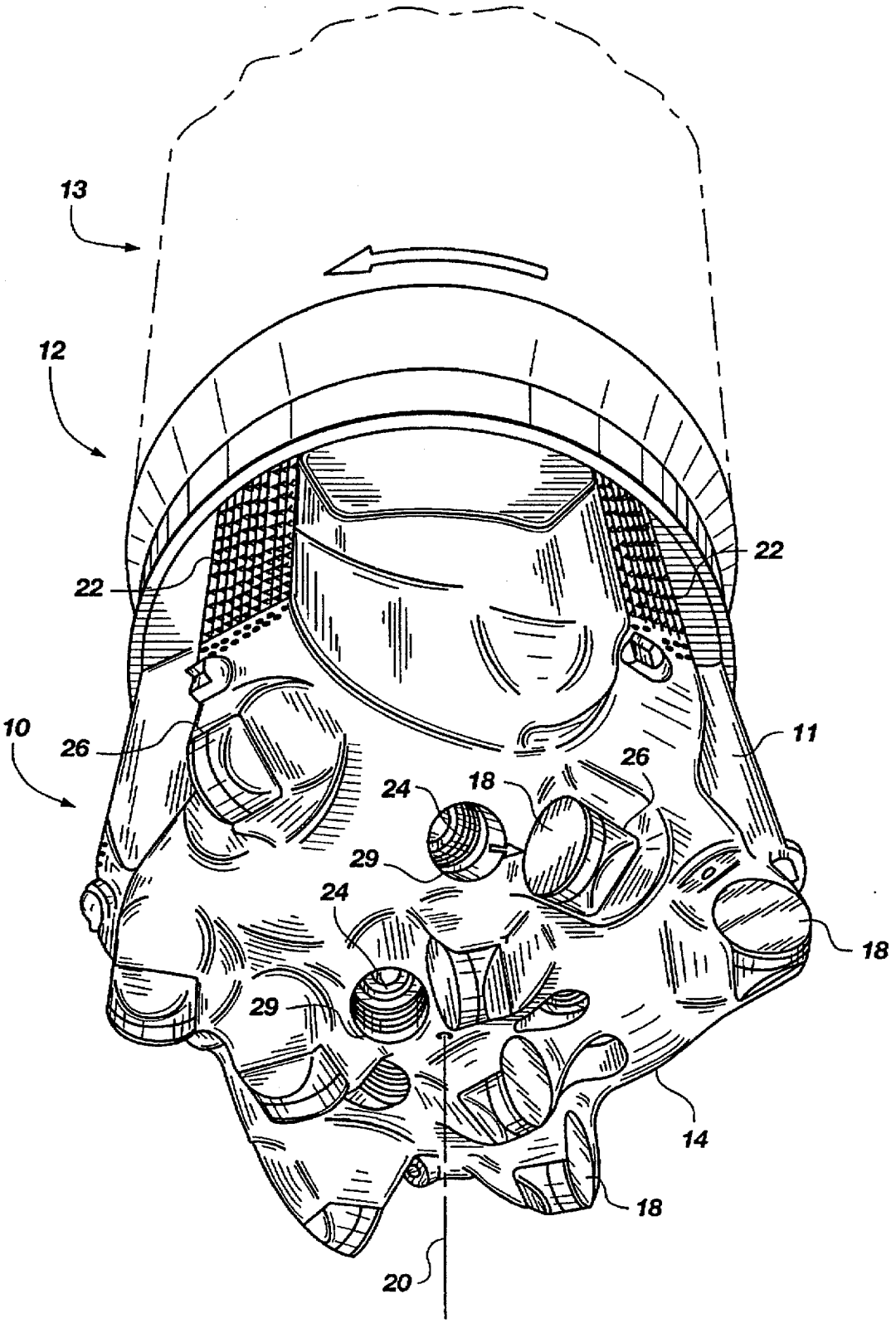
FIG. 1 is a perspective view of a drag bit in which are installed cutters and nozzles of the invention.

A rotary full bore drill bit known in the art as a drag bit is illustrated in FIG. 1. The drill bit 10 has bit body 11 which is typically formed of carbide matrix infiltrated with a binder alloy. The bit 10 is adapted to be connected as by a threaded connection, not shown, to a drill collar 12 into the drill string shown in phantom as 13. The operative face 14 of the bit body 11 has mounted therein an array of stud cutters or slug cutters 16 having preform cutting elements 18 fixed thereon. The cutting elements 18 may be preformed of a polycrystalline diamond material affixed to a tungsten carbide or metal slug or stud. Such polycrystalline diamond cutters (PDC cutters) are known in the art. The cutting elements 18 are positioned to cut the rock and/or earth as the bit 10 is rotated in a bore hole. Typically, the cutting elements 18 are aligned at an angle at which they rake cuttings away from central axis of rotation 20.

The bit body 11 may include kickers 22 on the gage which contact the walls of the bore hole and stabilize the bit in the hole. Drilling fluid is discharged through nozzles 24 in the face 14 of bit body 11 for lubricating and cooling the bit 10, and washing away the drilled cuttings, as well known in the art. The various embodiments of the locking mechanism of the invention may be applied to the mounting of stud or slug cutters 16 and nozzles 24 in exemplary drill bit body 11. The improved locking mechanisms of the invention as described herein enable rapid installation and removal of cutters and nozzles in the field, and prevent unwanted ejection of the cutters 16 from their sockets 26 and nozzles 24 from their sockets 29 in the bit body 11.

Figure 2:
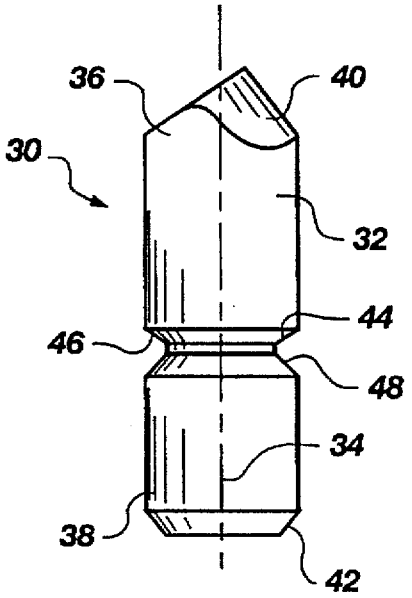
FIG. 2 is an elevation view of a stud cutter having a locking feature of the invention.

One form of the invention is illustrated in FIGS. 2 through 11. The stud cutter 30 of FIG. 2 is shown as having a generally cylindrical root 32 with a longitudinal central axis 34 extending from the cutting end 36 to an insertion end 38. A cutting element 40 of a desired type is fixed to the cutting end 36. The insertion end 38 is shown as having a bevelled circumferential edge 42 for enabling ready insertion of the stud cutter 30 into a cavity or socket in the drag bit. The cutting element 40 may be aligned with its flat cutting surface 43 perpendicular to axis 34 or other angle as desired (as shown) to provide an effective cutting angle in the borehole.

Between the ends 36 and 38 of the root 32, a circumferential, annular groove or cutout portion 44 encircles a major portion or all of the root 32. The lower face of the groove comprises a shoulder 48 useful for retaining the stud cutter 30 locked within the cavity or socket. The shoulder 48 is sloped upwardly in a direction toward the central axis 34. The roof 46 of the groove 44 may be sloped, rounded or perpendicular to axis 34. It is preferred that shoulder 48 and roof 46 comprise a curved surface of a single radius. Its shape is unimportant as long as it does not interfere with the locking mechanism described hereinafter.

The root 32 may alternatively have a cross-sectional shape which is other than round. For example, the root 32 may be oval, rectangular or multi-sided. In such cases, the stud cutter 30 is prevented by the root's shape from rotating in a similarly shaped socket in the bit.

Figure 3:
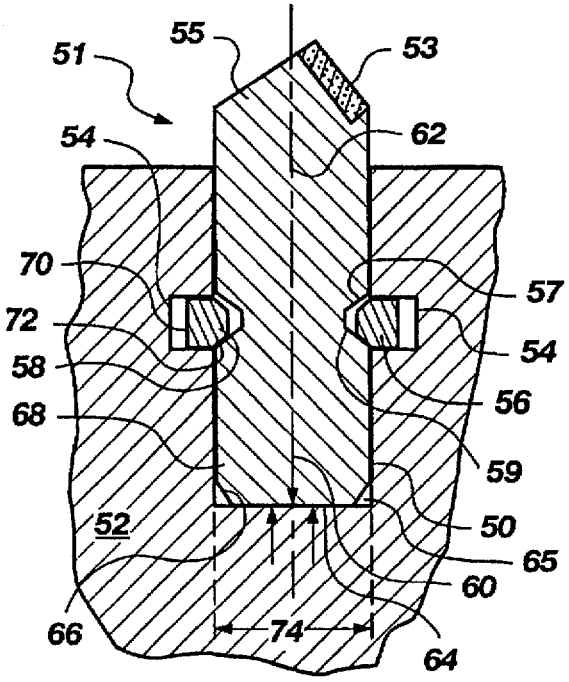
FIGS. 3, 3(*a*) is a cross-sectional side view of a stud cutter of the invention installed in a socket within a drag bit body.

FIG. 3 depicts a stud cutter 51 of the invention, as installed in a cavity or socket 50 within a drag bit body 52 partially shown in the figure. A cutting element 53 is fixed to the cutting end 55 of the stud cutter. A peripheral annular groove 54 is shown in the drag bit body 52, generally corresponding in position to the cutter groove 57 when the cutter 51 is fully inserted into the socket 50.

A resilient split ring 56 is retained within the annular groove 54 and has an inner portion 58 which normally projects into the socket 50. In one embodiment, the split ring 56 and cutter groove 57 are so aligned that when the stud cutter 51 is fully seated in the socket 50, the ring 56 contacts the shoulder 59 of the groove 57 in a loaded, i.e. a tensed radially expanded state. Thus, the ring 56 exerts a force 60 in axial direction 62 to maintain the stud cutter 51 in a forced state against the socket floor 64, and prevent ejection of the stud cutter 51 from the socket. Alternatively, the split ring 56 and cutter groove 57 are aligned so that when the split ring is fully seated in the cutter groove 54, the split ring is in a slightly expanded, tensed state, and there is no contact between the stud cutter 51 and the socket floor 64 or other portion of the socket 50 which prevents downward movement of stud cutter 51 in the bit body 52.

The socket bottom or floor 64 is preferably configured to provide a free space or pocket 65 adjacent the bevelled edge 66 of the insertion end 68 of the stud cutter 51.

The features of split ring 56 and its locking action are shown by reference to FIG. 3. Prior to installing the stud cutter 51 in the socket 50, the split ring 56 is first installed in the groove 54 by compressing its outer periphery 70 to a diameter less than the diameter 74 of the socket 50, sliding it into the socket 50, and permitting it to expand into the groove 54. The split ring 56 is shown as including a sloped locking surface 72 which communicates with the shoulder 59 of cutter groove 57, when the cutter 51 is operably installed in the socket 50. The alignment of the sloped locking surface 72 and the shoulder 59 is then such that the split ring 56 is prevented from fully returning to its unloaded, i.e. untensed state. Thus, as split ring 56 contracts to a loaded state where its diameter is greater than its original unloaded diameter, the split ring 56 forces the insertion end 68 of the cutter axially against the bottom 64 of the socket 50, and the insertion end 68 is held in compression by force 60 parallel to the central axis of stud cutter 51. The frictional forces between sloped surface 72 and shoulder 59, together with the frictional forces between the insertion end 68 and the socket bottom 64, tend to limit the rotatability of the stud cutter in the socket.

As the insertion end 68 of the stud cutter is inserted downwardly into the socket 50, it expands the split ring 56 to an external diameter greater than diameter 76, and the split ring 56 extends laterally into groove 54. Just prior to contact between the insertion end 68 and the socket bottom 64, the split ring 56 partially unloads into cutter groove 57 and fully seats the stud cutter 51 in the socket, axially loading insertion end 68 against drag bit body 52.

Figure 3A:
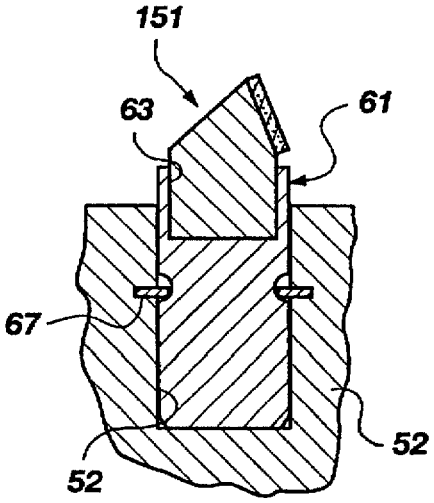

FIG. 3A illustrates a variation of the embodiment of FIGS. 2 and 3, wherein a stud cutter 151 is brazed, shrink fit or press fit (or otherwise suitably secured) to a carrier element 61 of a material other than the WC of the cutter body of the stud cutter 51 within socket 63 of the carrier element 61. As described subsequently with respect to FIG. 4, carrier element 61 may be secured within socket 50 of bit body 52 with a retaining element 67 comprising a resilient or flexible collar, or a collar of memory metal, in lieu of a split ring.

Figure 4:
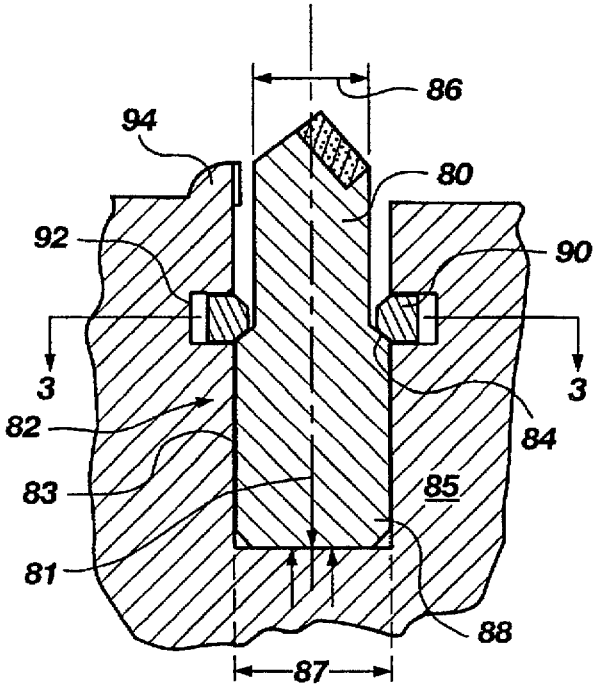
FIG. 4 is a cross-sectional side view of another embodiment of the stud cutter as installed in a socket within a drag bit body.

Turning now to FIG. 4, a further embodiment of the invention is shown. Stud cutter root 82 has a longitudinal central axis 81 and is shown mounted in socket 83 in drill bit body 85. This version differs from that of FIG. 3 in that the upper portion 80 of the stud cutter root 82, i.e., the portion above the shoulder 84, has a diameter 86 less than the diameter 87 of lower root portion 88. As in FIG. 3, the resilient split ring 90 mounted in annular groove 92 is partially loaded, i.e. expanded when seated on the shoulder 84. This version permits the upper root portion 80 to bend or flex upon application of high loads by the material being drilled, while the lower root portion 88 is in a compressed mode. Thus, drilling forces are relieved to reduce wear of the cutting elements, while stud cutter ejection is prevented. As shown, a stop 94 may be employed behind the stud cutter root to limit flexure of the upper root portion 80. Further, it is contemplated that a flexible collar rather than a split ring 90 may be employed, and installed in position within a mold or boat before fabrication (binder infiltration of a WC or other suitable matrix powder) of a matrix-type bit so as to eliminate the need for machining a groove 92 or installing a split ring 90. The flexible collar may comprise a flat washer, a frusto-conical washer, a collar with radial kerfs, or other suitable structure. Similarly, an expandable collar of memory metal may be employed, rather than a flexible or resilient collar.

Figure 5:
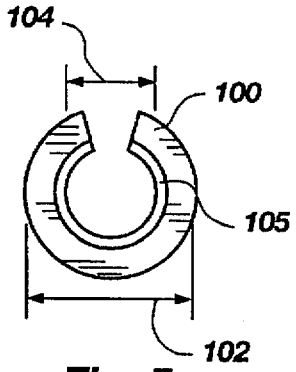
FIG. 5 is a bottom view of a split ring of the present invention in an unstressed condition prior to placement of the stud cutter into the socket of a drag bit body.
Figure 6:
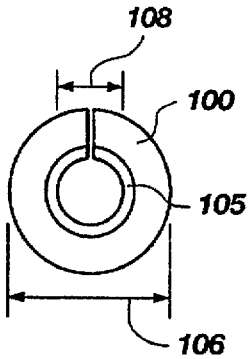
FIG. 6 is a bottom view of a split ring of the present invention in a compressed condition for installation in a socket within a drag bit body.
Figure 7:
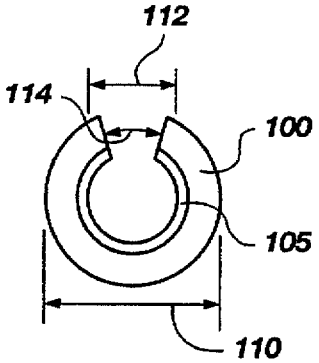
FIG. 7 is a bottom view of a split ring of the present invention in an expanded stressed condition which locks the stud cutter into a socket within the drag bit body.

FIGS. 5–7 illustrate the radial expansion and compression of a split ring 100 during its installation and use. The split ring 100 is designed to be radially compressed or expanded from its unstressed shape under increasing force. In FIG. 5, the split ring 100 is shown in an unstressed condition, being neither compressed nor expanded. It has a relaxed outside diameter 102 and an inside diameter 104. The ring 100 includes a surface 105 which is configured to be in loaded contact with a stud cutter shoulder such as 59 or 84.

In FIG. 6, the split ring 100 is shown as radially compressed for installation into the annular groove extending outwardly from the socket, as previously described. The outside diameter 106 is less than the outside diameter 102 of FIG. 5, and the inside diameter 108 is less than the inside diameter 104 of the uncompressed split ring 100 of FIG. 5.

FIG. 7 shows the split ring 100 in an expanded condition as it is when the stud cutter is installed in the socket. In this position, the gap 114 of the split ring is opened up. Outside diameter 110 is greater than outside diameter 102 or 106 of FIGS. 5 and 6, respectively. Inside diameter 112 is expanded to a diameter exceeding the diameter of the stud cutter root as the root is pushed through it to install the cutter in the socket. Inside diameter 112 of split ring 100 is thus greater than inside diameters 104 and 108 of FIGS. 5 and 6, respectively. The ring 100 remains in a loaded, somewhat expanded state to lock the stud cutter within the socket.

Figure 8:
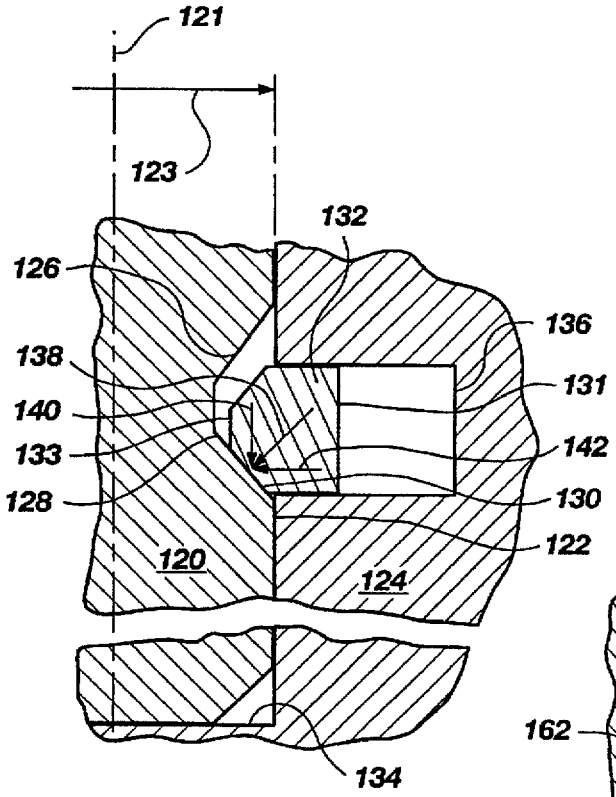
FIG. 8 is an enlarged cross-sectional side view of a portion of FIG. 3, illustrating the locking mechanism of the invention.

FIG. 8 illustrates the locking mechanism of the split ring and associated cutter groove in the present invention, and includes exaggerated dimensions for clearer presentation. Stud cutter 120 having a longitudinal central axis 121 and diameter 123 is shown fully inserted in socket 122 within drill bit body 124. Stud cutter 120 is shown as fitting closely within socket 122. A circumferential groove 126 circumscribes the stud cutter 120 and includes a lower sloped shoulder 128 to which a corresponding surface 130 of resilient split ring 132 communicates. Split ring 132 has an outer diameter 131 and an inner diameter 133, and is movably mounted in annular groove 136 in the bit body 124. The dimensions of the stud cutter 120, shoulder 128, socket 122, socket floor 134, and split ring groove 126 are coordinated so that when the cutter 120 is fully seated on socket floor 134, surface 130 impinges on shoulder 128 and the loaded split ring 132 applies a force 138 on shoulder 128. The force 138 has an axial component 140 and a radial component 142, the latter acting to force the stud cutter 120 downward against the socket floor 134 and prevent its ejection during drilling operations. As noted previously with respect to previous embodiments, it may be desirable to form groove 36 with an arcuate or radiused cross-section.

Figure 9:
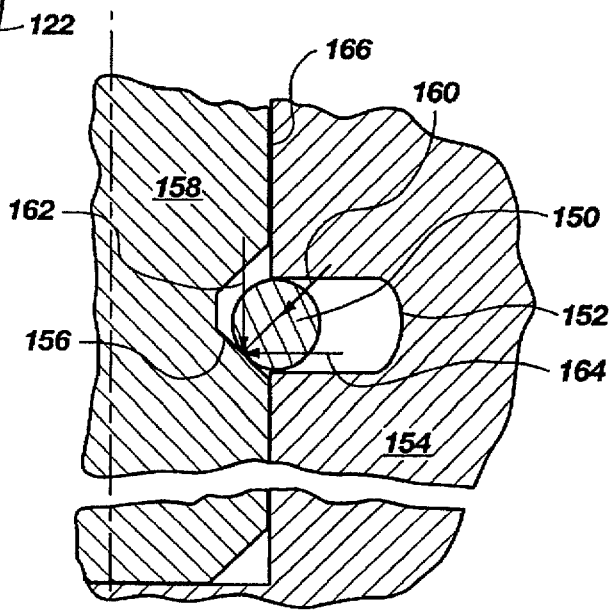
FIG. 9 is an enlarged cross-sectional side view illustrating the locking mechanism of another embodiment of the invention.

The split ring surface 130 which impinges on the shoulder 128 need not be flat. As shown in FIG. 9, a split ring 150 has a round cross-sectional shape and is mounted in groove 152 in bit body 154. The split ring 150 is held in a loaded condition against shoulder 156 of the stud cutter 158 when the latter is fully seated. The split ring 150 exerts a force 160 against the shoulder 156, and the force 160 has an axial component 162 and a radial component 164. The latter force retains the stud cutter 158 locked within the socket 166.

Figure 10:
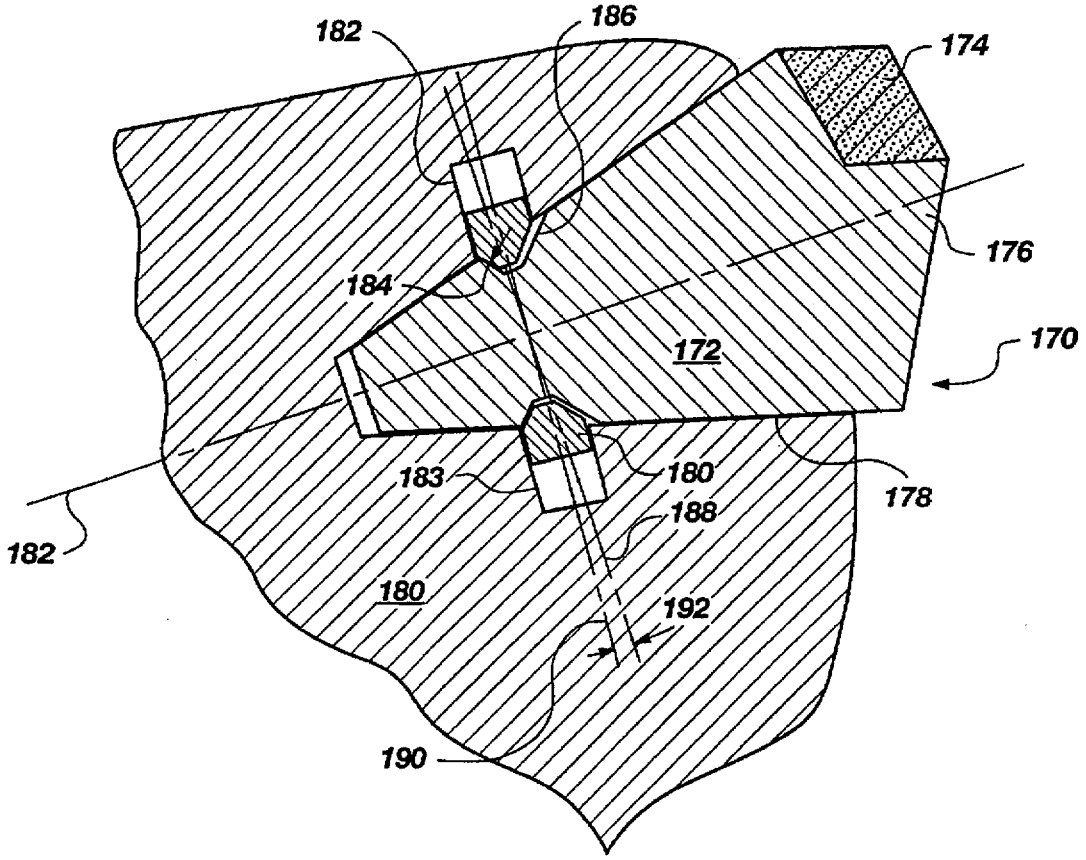
FIG. 10 is an enlarged cross-sectional side view illustrating the locking mechanism of a further embodiment of the invention.

FIG. 10 illustrates a slug cutter 170 having a conical rather than cylindrical body or root 172. A cutting element 174 is mounted on the larger, i.e. cutting end 176 of root 172. The cutter 170 is shown mounted in a matching conical socket 178 in the drill bit body 180. The cutter 170 has a longitudinal axis 182, and may have a cross-section which is round, oval or rectangular. Preferably, cutter 170 has a round cross-section for ease of forming the cutter as well as the socket 178.

Resilient split ring 180 is shown mounted in groove 183 in body 180 to intersect a shoulder 184 of circumferential groove 186 in the cutter 170. The split ring 180 and grooves 183, 186 may be aligned in a plane 188 perpendicular to longitudinal axis 182. In this configuration, the stud cutter 170 may be rotated by drilling forces.

If rotation of the cutter 170 is undesirable, the split ring 180 and grooves 183, 186 may be aligned in a plane 190 not perpendicular to axis 182. Thus, the split ring 180 and grooves 183, 186 are pictured as varying from the perpendicular 188 by an offset angle 192. In this configuration, any rotation of the cutter 170 produces axial forces on the split ring 180 and also results in expansion of the split ring 180. The force required to further rotate the ring 180 is thus increased. In general, the greater the angle 192, the greater is the resistance to rotation. An offset of 1–20 degrees or more, up to about 60 degrees, is found useful. This feature is not restricted to conical cutters but may be used with any otherwise-rotatable shape of cutter using a split ring type of locking mechanism.

The embodiments of the invention illustrated in FIGS. 1–10 are particularly useful where a blind socket must necessarily be used. However, they may also be useful where a through-hole socket is readily made.

Figure 11:
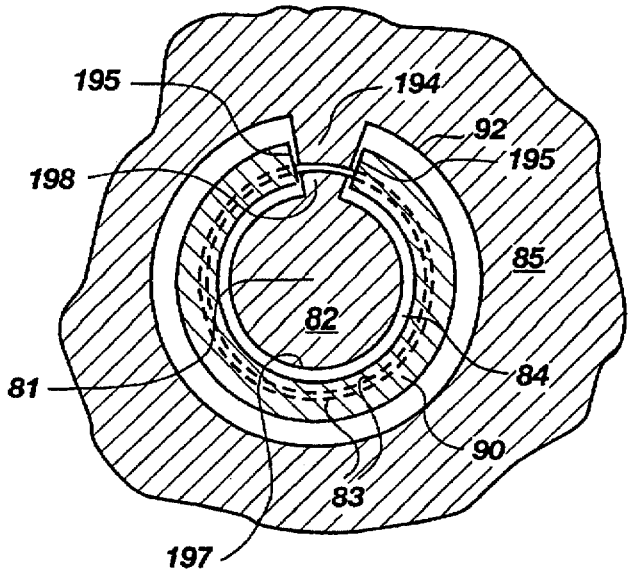
FIG. 11 is an enlarged cross-sectional top view of the locking mechanism taken along line 3—3 of FIG. 4.

The locking mechanisms described above may be modified to provide a non-rotatable cutter. FIG. 11 is a cross section of FIG. 4 taken along lines 3—3, as adapted for non-rotation of the stud cutter. As before described, cutter root 82 has longitudinal central axis 81 and fits in socket 83 within drill bit body 85. The cutter root 82 includes a shoulder 84 which contacts a loaded split ring 90. The nonrotation feature includes an incomplete annular groove 92 in the bit body 85, corresponding to the split ring 90. The annular groove includes less than the complete circumference of the socket 83. Thus, inward extension 194 of bit body 85 is adapted to fit between the ends 195 of split ring 90. Likewise, peripheral groove or inset 197 in cutter root 82 is incomplete, such that outward extension 198 of the cutter root 82 also fits between the ends 195 of split ring 90. The split ring 90 is held non-rotatable by inward extension 194, and the split ring 90, in turn, retains the outward extension 198 of the cutter root 82 in a non-rotatable position. The annular groove 92 is sized to permit ready installation of the split ring 90 into the groove 92, and the cutter may be installed in only one radial position.

Figure 12:
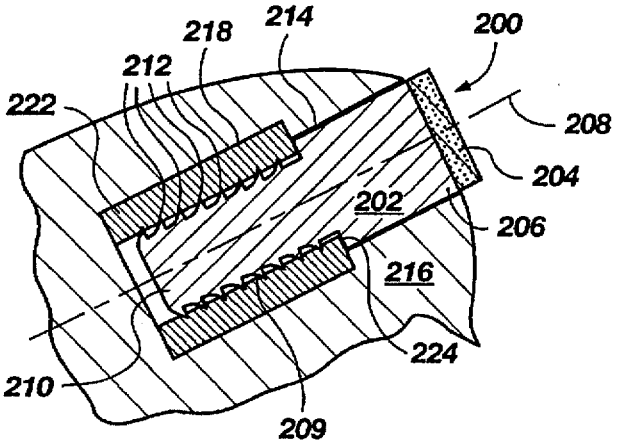
FIG. 12 is an enlarged cross-sectional side view of a still further embodiment of the locking mechanism of the invention and socket.
Figure 13:
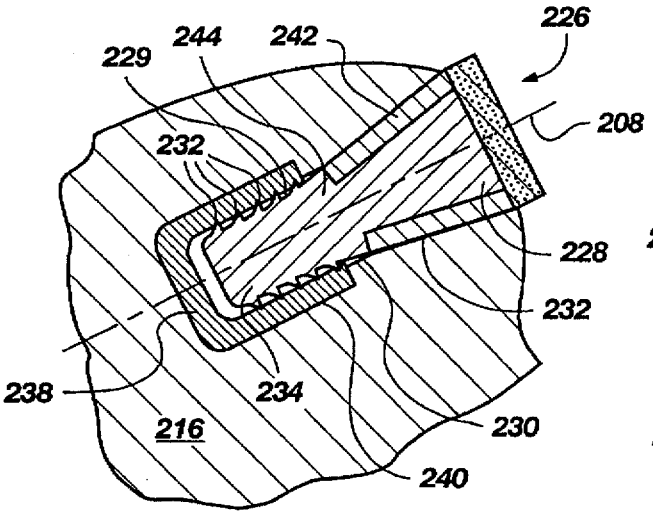
FIG. 13 is an enlarged cross-sectional side view of another embodiment of the locking mechanism of the invention in a slug cutter and socket.

FIGS. 12 and 13 illustrate other embodiments of the invention. In FIG. 12, a generally cylindrical cutter 200 has a body 202 with a cutting element 204 mounted on the cutting end 206 and a longitudinal central axis 208. The insertion end 210 is of generally smaller diameter than the cutting end 206. The body 202 has a locking surface 209 adjacent the insertion end 210 which has formed thereon a series of sharp edged radial projections 212 such as circular ridges or barbs comprised of a hard material. A socket 24 preformed or drilled in the drill bit body 216 has a recess 218 in a lower portion of the socket 214. An annular sleeve element 222 of metal or other suitable material may be placed in the recess 218 and is shown extending into the socket space to form a shoulder 224. The element 222 has a hardness value less than that of the ridges 212, so that the cutter 200 may be inserted with force into the element 222 and retained by friction within the element 222 by the sharp ridges or barbs 212. The shoulder 224 generally retains the cutter 200 at the desired depth within the socket. The cutter 200 is retained in a non-rotatable position by the softer element 222, but may be pulled from the socket 214 by force when desired. If a ductile bit body is employed, element 222 may be eliminated and barbs 212 may directly engage the bit body material. A substantial portion of the cutter body 202 is configured as a locking surface 209 to ensure rigidity of the cutter within the socket 214. It is further contemplated that sleeve element 222 may be of a harder material and include barbs to engage the smooth surface of a softer cutter body 202. The cutter body 202 may comprise a ductile root with a harder jacket closer to cutting element 204 to resist abrasion and erosion. It is also contemplated, given modern layered manufacturing techniques commonly employed in rapid prototyping, that the body may be formed with engagement barbs or grooves or that the sleeve may be formed in situ during fabrication of the bit body.

FIG. 13 depicts a cutter 226 similar to the cutter 200 of FIG. 12. The cutter 226 however has a conical cutting end 228 which fits into a socket 230 with a conical upper portion 232. A locking surface 229 adjacent the insertion end 234 of the cutter 226 has sharp projections 232, e.g. ridges or barbs formed on it which slightly penetrate a softer element 238 formed or placed in a recess 240 of the socket 230. A friction fit results which retains the cutter 226 in the socket 230, but enables removal when desired by using a pulling force. FIG. 13 shows cutter 226 as having its conical portion 228 formed of an exterior hollow cone 242 surrounding a metallic core 244. Core 244 may be hardened steel or other strong and ductile metal, while hollow cone 242 is typically formed of a material highly resistant to erosion, such as silicon carbide.

With respect to FIGS. 12 and 13, it is also contemplated that the cutter roots or the sleeves or other receptacles in the sockets may be formed of a material susceptible to melting upon generation of heat by spinning the cutters within the sockets so as to sense the cutters therein by friction welding.

Figure 14:
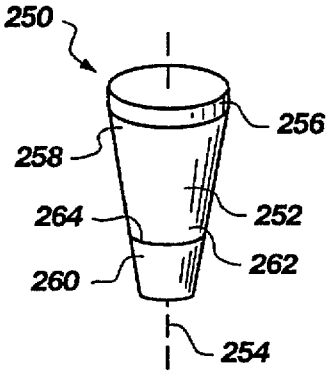
FIG. 14 is a perspective view of a slug cutter having a further embodiment of the locking mechanism of the invention in a stud cutter.

Another form of the invention is illustrated in FIGS. 14 through 17 and is useful where blind sockets are used. In FIG. 14, a cutter 250 is comprised of the cutter body 252 having a central longitudinal axis 254, a cutting element 256 mounted on the cutting end 258, and a friction-weldable metal member 260 fixedly mounted on the insertion end 262 of the cutter body 252 at interface 264. The metal member 260 may be formed of aluminum or aluminum alloy, for example. The temperature required to soften or melt the metal is easily generated by friction, but higher than temperatures usually associated with drilling operations.

Figure 15:
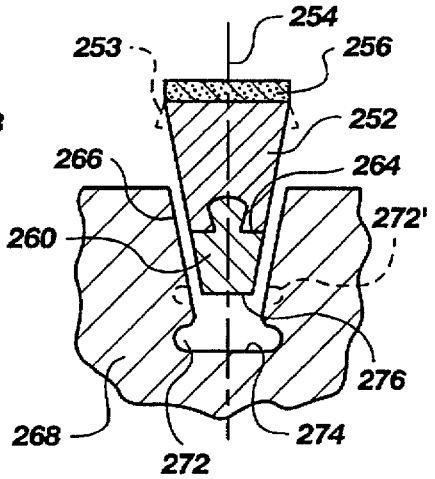
FIG. 15 is a cross-sectional side view of the slug cutter and socket having a further embodiment of the locking mechanism of the invention.

In FIG. 15, the cutter 250 is shown in lateral section, ready to be mounted and locked into the socket 266 in bit body 268. The generally conical socket 266 accepts the cutter 250 such that cutting element 256 protrudes as desired when the cutter is fully seated. The socket 266 includes a radially extended portion 272 at the inner end 270 of the socket. The floor 274 of the socket 266 has a shape which generally matches that of the insertion end 276 of the cutter 250.

The stud cutter 250 is lockingly mounted in the bit body 268 by rapidly rotating the cutter 250 about axis 254 while insertion end 276 is in frictional contact with floor 274. The fiction-generated heat melts or softens the metallic member 260 which flows radially by centrifugal force into the radially extended portion 272 of the socket 266. Rotation is then halted and the melted/softened metallic member 260 cools and congeals within the extended portion 272 to lock the cutter 250 into the socket 266.

It is also contemplated that a radially extended portion 272' may be located above floor 274 of socket 266 as shown in broken lines. Further, the upper portion of cutter body 252 may be flared outwardly (either integrally or by addition of another element) as shown in broken lines at 253 to protect the cutter body/socket interface against abrasive and erosive drilling fluid action.

Figure 16:
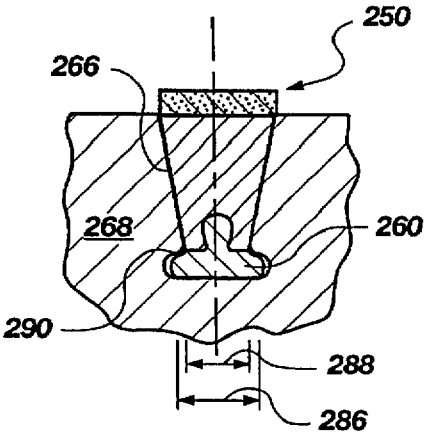
FIG. 16 is a cross-sectional side view of a completely mounted slug cutter of FIG. 15 in a drill bit body.

FIG. 16 depicts the cutter 250 lockably mounted in the socket 266 of the bit body 268. The metallic member 260 is of greater dimension 286 than the diameter 288 of the socket neck 290, preventing undesired loosening and loss of the cutter 250 during drilling operations.

Figure 17:
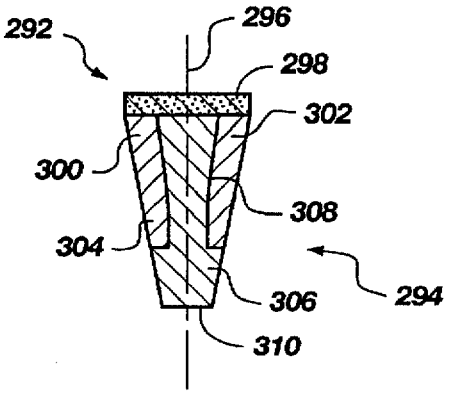
FIG. 17 is a cross-sectional side view of an additional embodiment of the locking mechanism of the invention in a slug cutter.

Another embodiment of the cutter is illustrated in FIG. 17. The cutter 292 has a conical cutter root 294 having a central longitudinal axis 296. A cutting element 298 is mounted on the cutting end 300. The cutter root 294 is formed with a hollow exterior wall 302 of hard, abrasion and erosion-resistant material. At the smaller end 304 of wall 302, a friction-weldable metallic member 306 extends axially from the wall 302, and also extends into the hollow cavity 308 within the exterior wall 302. The cavity 308 and member 306 contained therein are enlarged at the cutting end 300 to prevent separation of the wall 302 and metallic member 306 during drilling operations. Like the embodiment of FIG. 15, the cutter 292 is mounted in a socket by rapidly rotating the cutter about axis 296 while the insertion end 310 is in frictional contact with the socket floor for melting/softening and expansion of the deforming metal member 306, as previously described.

Figure 18:
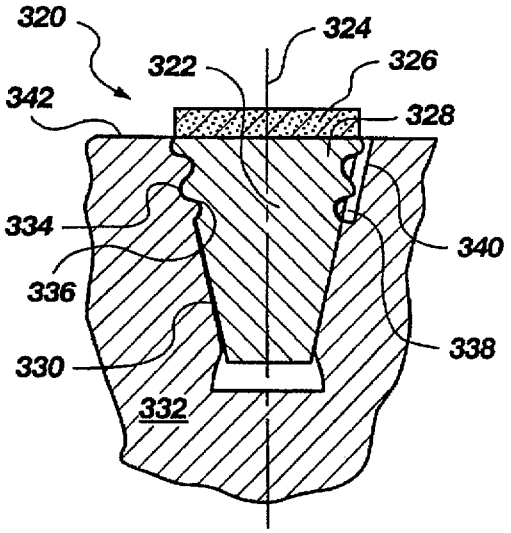
FIG. 18 is a cross-sectional side view of a further embodiment of the locking mechanism of the invention in a slug cutter.

A further form of the invention which includes a screw thread is shown in FIGS. 18 through 23. As depicted in FIG. 18, stud cutter 320 has a truncated conical cutter body 322 with longitudinal central axis 324. A preform cutting element 326 is shown fixedly mounted on the cutting end 328 of the body 322. The cutter 320 fits into a generally truncated conical socket 330 in the drill bit body 332. The socket 330 contains helical screw threads 334 on its upper portion. The cutter body 322 has matching screw threads 336 on the upper conical portion 336, for tightly screwing the cutter 320 into the socket 330. Thus, the threads are on conical surfaces and provide limited contact area for locking. The socket depth is shown as exceeding the length of the cutter body 322, to ensure a tight fit of cutter 320 into socket 330. A key 338 is driven into a generally axially oriented keyway 340 from the bit body surface 342, to lock the cutter 320 into the socket 330.

Figure 19:
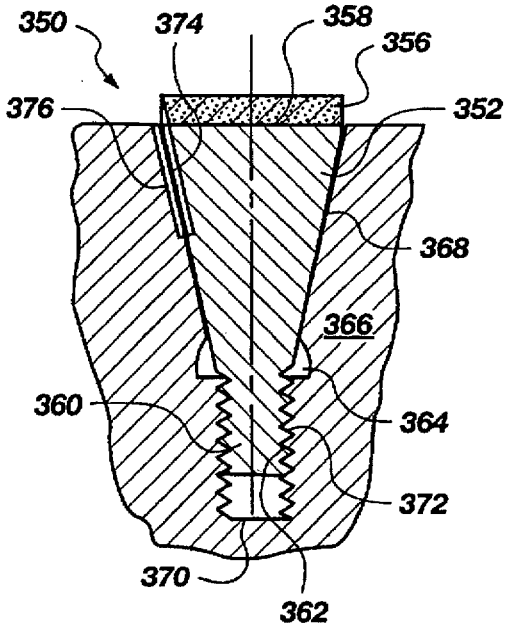
FIG. 19 is a cross-sectional side view of another embodiment of the locking mechanism of the invention in a slug cutter.

In FIG. 19, cutter 350 has a cutter body 352 with an upper conical portion 354 and a lower cylindrical insertion end 360. A cutting element 356 is fixed to the upper end 358 of the conical portion 354. The cylindrical insertion end 360 is threaded with helical screw threads 362. The cutter 350 fits into a socket 364 in bit body 366, and has an upper conical portion 368 and a lower cylindrical portion 370 threaded with helical screw threads 372 to match threads 362. The cutter 350 is screwed into the socket 364 and then locked immovably therein by a key 374 which is fitted into keyway 376 at the interface between the conical portion 354 and the bit body 366. The cutter 350 is thus prevented from either rotational or axial movement.

Figure 20:
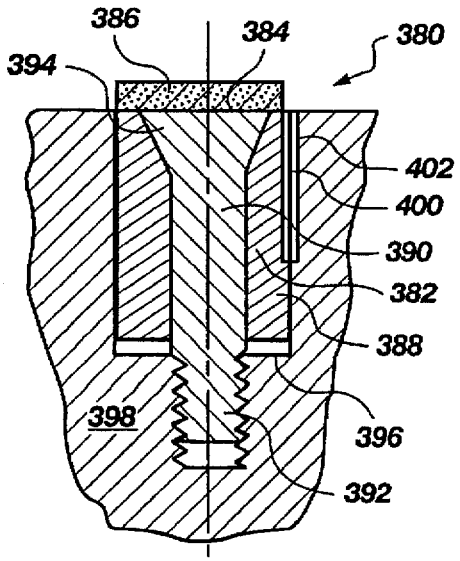
FIG. 20 is a cross-sectional side view of another embodiment of the locking mechanism of the invention in a slug cutter.

The cutter 380 of FIG. 20 has a cylindrical cutter body 382 having a cutting end 384 to which a cutting element 386 is affixed. Cutter body 382 is depicted as comprising an annular wall 388 enclosing a core 390 which extends downwardly from the wall 388 to form a helically threaded insertion end 390 of smaller diameter than the annular wall 388. Alternatively, a single component cutter body may be used, and the insertion end 392 and cutting end 384 may have the same diameter if desired. As shown, the core 390 has an enlarged cutting end 394 which locks the core 390 into the annular wall 388. The cutter 380 is locked into the socket 396 of bit body 398 by a key 400 placed in keyway 402.

Any of the embodiments of the invention described herein may use a key and keyway to prevent rotation of the cutter in the socket, if other non-rotation means are not used.

Figure 21:
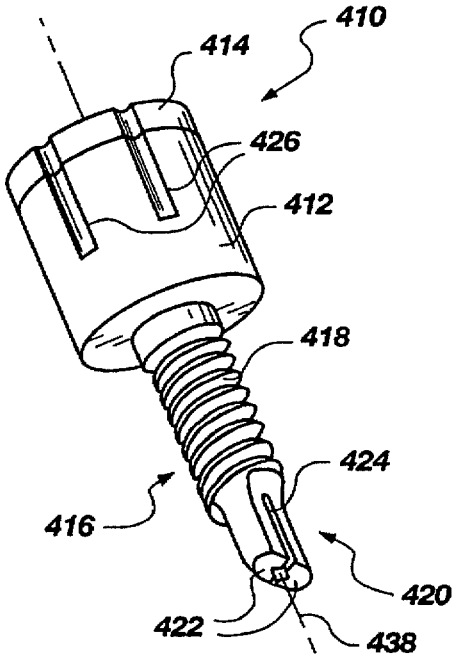
FIG. 21 is a perspective view of yet another embodiment of the locking slug cutter of the invention.

FIG. 21 illustrates another form of the invention. A cutter 410 has a cutter body 412, to which is attached a cutting element 414. The body has a central axis of rotation 438. Coaxial with the body 412 is a cylindrical insertion end 416 which includes a threaded outer surface 418 above a tip portion 420. The insertion end 416 is shown as having a smaller diameter than the body 412. The tip portion 420 of the insertion end 416 is split by slit or slits 424 into two or more fingers 422, each of which is radially swageable in an axial direction to separate and flare away from the axis 438. The cutter 410 is shown with one or more keyways or grooves 426 into which a key, not shown, may be installed for preventing rotation of the cutter 410 once installed in its socket. Optionally, the flare of fingers 422 into slot 440 as depicted in FIG. 22 maintains cutter 410 in a rotationally fixed position.

Figure 22:
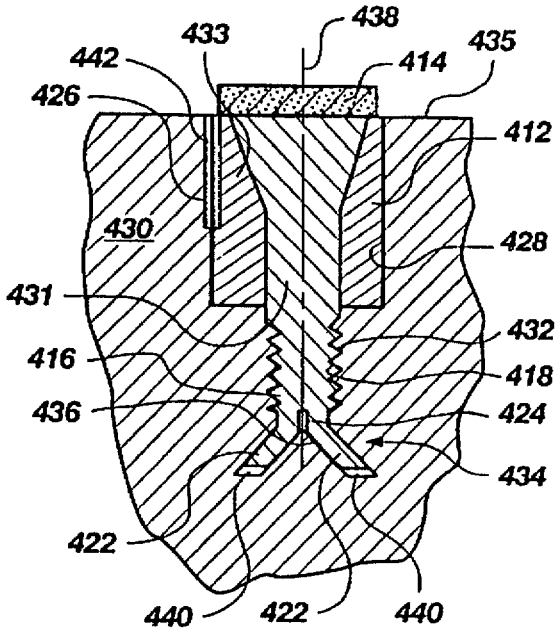
FIG. 22 is a cross-sectional side view of a locking slug cutter of the invention in a socket within a bit body.

In FIG. 22, cutter 410 is shown installed in specially formed socket 428 in bit body 430. The socket 428 includes a threaded cylindrical insertion end 432 to match threads 418. In the lower end 434 of the socket 428, below the threads 432, an upwardly directed conical socket base 436 is aligned in center axis 438. The cone 436 is formed by removal of bit material in a conically shaped slot 440 which diverges downwardly from the axis 438 in a complete circumference.

Cutter 410 is installed in socket 428 by screwing it into threads 432. When the tip 420 reaches cone 436, the tip fingers 422 of the tip 420 are swaged outwardly to flare into slot 440 by downward movement of the cutter 410. The force required to unscrew the cutter 410 and bend the fingers back to their original unflared position, is greater than will occur in drilling operations, so the cutter 410 is locked into its seated position in the socket 428. However, if desired, a further lock may be utilized, i.e. insertion of a key 442 in a keyway 426, as previously described. Use of key 442 prevents minor rotational movement of the cutter 410 in the socket 428.

FIGS. 21 and 22 show the cutter body 412 similar to the body 382 illustrated in FIG. 20, that is, a body having a core 431 joined to an exterior annular wall 433. The core 431 is shown as extending downwardly to form the insertion end 416. Alternatively, the shape of the body may be conical or stepped, or any shape which will "bottom out" at a predetermined depth to correctly position the cutter element 414 above the surface 435 of the drill bit body 430. The cutter body 412 may be formed of two parts. A core 431 is cast and/or machined of a material of high tensile strength. An annular outer wall 433 may be cast and/or machined of a material highly resistant to abrasion and erosion. The two parts may be joined by cementation, brazing, welding, etc. to form a single body 412. Alternatively, the body may be formed in one piece from a single material to be used as is or coated, plated or otherwise covered with a resistant material.

Figure 23:
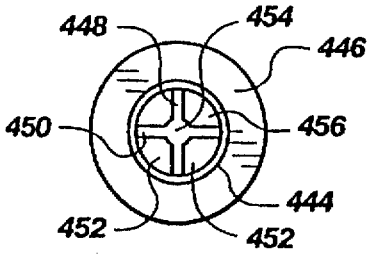
FIG. 23 is an end view of the insert end of another embodiment of the slug cutter of the invention.

FIG. 23 illustrates a swageable tip 444 of a cutter 446, in which the tip 444 is split by slits 448 and 450 into sectors, e.g. four quadrant fingers 452. The intersection 454 of the slits is preferably enlarged slightly to ensure alignment of the tip of the conical socket base 436 (FIG. 22) with the intersection 454. The cross-sectional area 456 of each finger is controlled so that the fingers may be swaged outwardly with moderate force and once swaged, will remain separated and flared into slot 440 to retain cutter 446 in the seated position.

Many of the problems inherent in the drilling of rock are the result of excessively stressed components. Often, a change in formation produces high forces on the cutting elements, stud bodies, and the attachment means. Thus, stud or slug breakage, diamond-to-carbide bond failure, braze failure and pocket/wing fracture result from overly stressed components.

Figure 24:
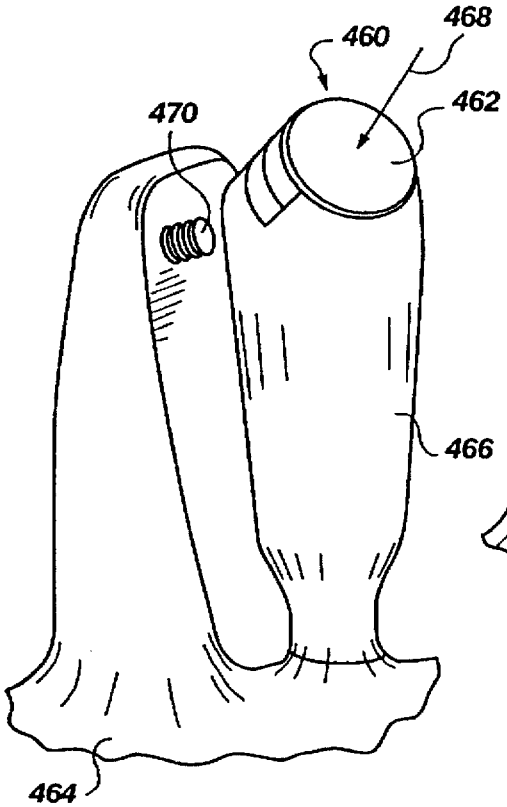
FIG. 24 is a perspective view of an additional form of the invention.
Figure 25:
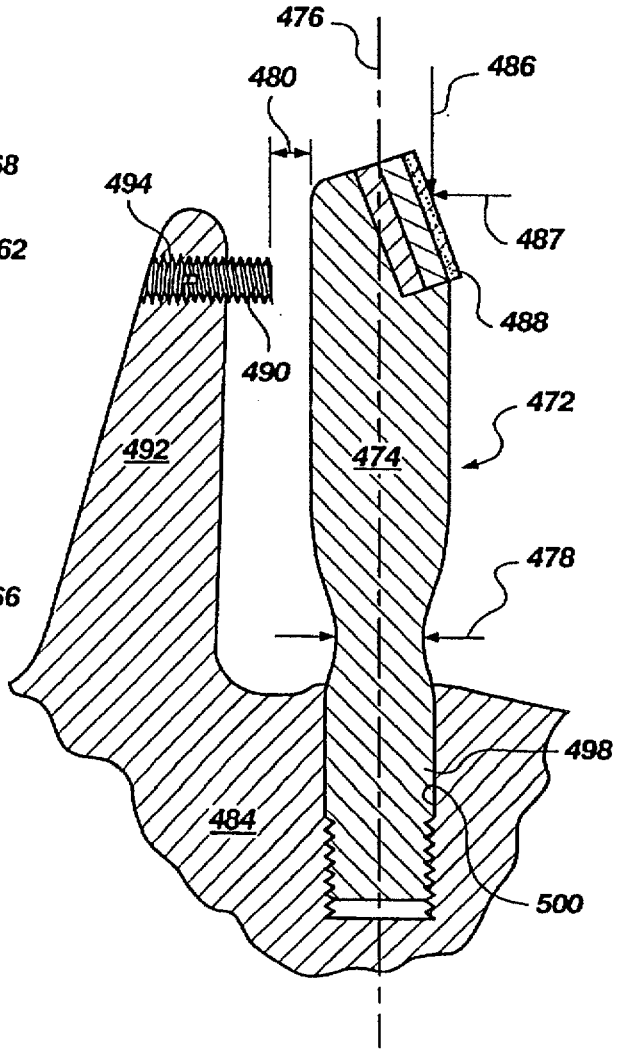
FIG. 25 is a cross-sectional side view of another form of the invention.
Figure 26:
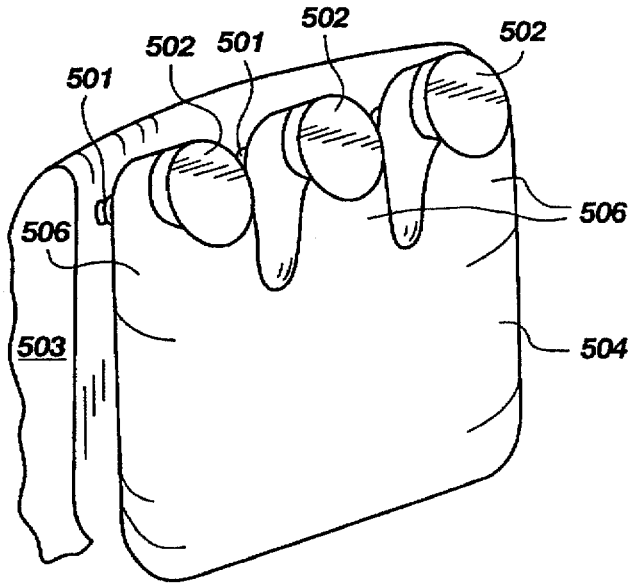
FIG. 26 is a perspective view of a further embodiment of the invention.

FIGS. 24 through 26 depict a form of the invention in which the forces acting on the cutter are reduced by using a projecting compliant stud cutter. The stud cutter is designed to be compliant in a direction perpendicular to the cutter surface. As a cutter hits a hard section of the borehole bottom, it bends or retracts sufficiently to relieve the high stress placed upon it. The hard spot is removed in several passes, rather than in a single pass. The primary direction of movement is horizontal, i.e. rotational. Hence, each cutter or blade is mounted on a relatively vertical (generally parallel to the bit axis) cantilever beam on the drag bit. A rigid stop is provided for preventing the beam from exceeding its elastic limit. For ease of understanding the construction, the figures depict the stud cutters in a generally inverted position to their normal operating orientation when the drill bit is in the borehole.

Turning now to FIG. 24, stud cutter 460 with attached cutter element 462 is shown as projecting from bit 464. The stud cutter elongate stem 466 is formed of a compliant material such as stainless steel alloys, nickel alloys, steel alloys or beryllium copper alloys. The stem 466 is a cantilever beam which bends under a bending moment resulting from 468 applied by the material through which the borehole is drilled. A stop 470 is provided for limiting the distance which the stud cutter may bend. If drilling conditions warrant, the stem 466 may be made of a non-complaint or stiff material to merely provide a large clearance for the cutting element so that, for example, kerfing may be facilitated.

As shown in FIG. 25, stud cutter 472 with elongate compliant stem 474 has a generally longitudinal axis 476. A stem diameter 478 is predetermined to provide a desired deflection 480 of the stem 474 as a bending moment is applied. Rotation of the bit 484 against rock in the borehole applies a force 486 generally a long axis 476 together with a rotative force 487 directed against the cutting element 488. The cutter may also be mounted so that the rotative force is more generally aligned with axis 476. An adjustable stop 490 is shown mounted in projection 492 for limiting the bending of the stem 474 of stud cutter 472 under the applied forces. In this illustration, adjustable stop 490 is a threaded lock screw which is installed in a threaded hole 494 extending through projection 492. The available bending distance 480 is controlled by adjusting stop 490 with a screwdriver, other stop means, either adjustable or preset, may also be used.

Figure 25A:
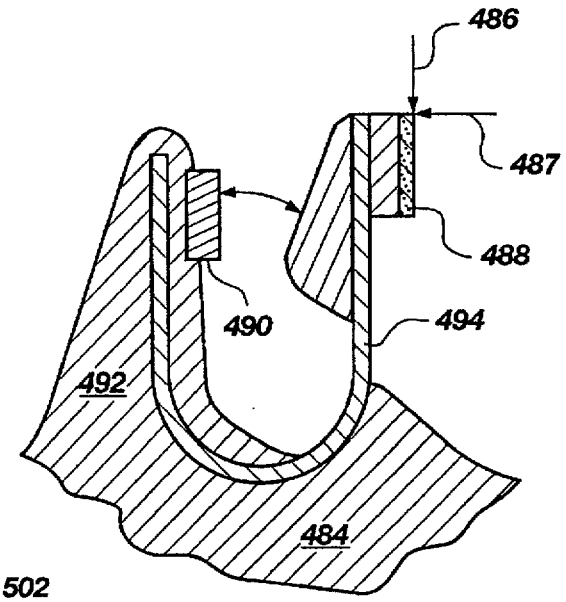
FIG. 25A is a cross-sectional side view of a variation of the structure depicted in FIG. 25.

In FIG. 25, stud cutter 472 is preferably shown as a separately formed component with a threaded insertion end 498 which is installed into threaded socket 500 in bit 484. Any locking mechanism as described herein may be used to keep the stud cutter 472 fixedly and non-rotatively aligned in the socket 500. Alternatively, the compliant stud cutter may be formed integrally with the bit 484 as depicted in FIG. 25A, wherein a generally U-shaped member 496 is cast into the matrix of a bit 484. It is also possible to orient the compliant member transversely to the bit axis to provide resilient cutter mountings against normal forces, as desired, or against a combination of normal and tangential forces.

FIG. 26 illustrates a modification in which multiple cutting elements 502 are installed on a single compliant stud cutter stem 504. Three cutting elements 502, each having the same general orientation, are fixedly attached on separate cutting ends 506 of the stud cutter skin 504. The stud cutter stem 504 may be integrally formed with the bit (see FIG. 25A) or may include lockable insert ends, not shown, for attachment to the bit. Stops 501 are shown attached to an extension 503 of the drill bit body, for limiting the available bending distance of the stud cutter 504.

Figure 27:
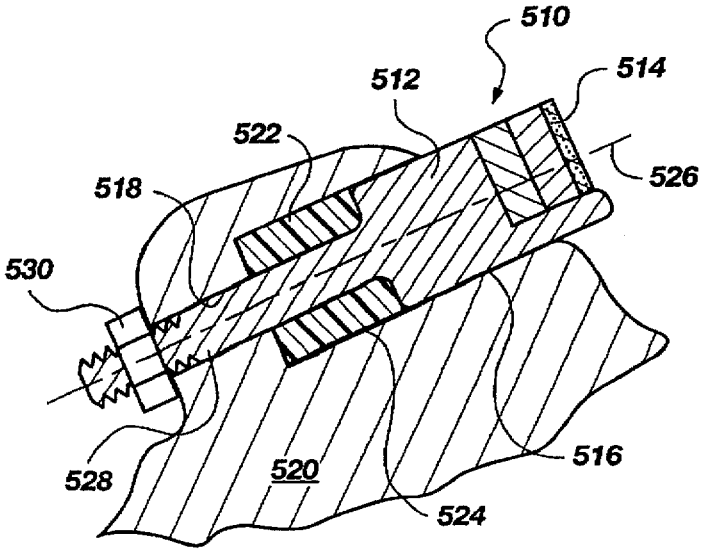
FIG. 27 is a cross-sectional side view of a yet further embodiment of the locking mechanism of the invention.

FIG. 27 depicts another form of cutter which reacts longitudinally in a resilient manner to drilling forces. Cutter 510 has a body 512 to which a cutting element 514 is attached. The stud cutter 510 is installed in a socket 516 having a through hole 518 in bit body 520. A resilient annular member 522 is installed in the lower portion 524 of socket 516, surrounding a smaller diameter portion of body 512 to absorb high transient forces which impinge on cutting member 514 at an angle with axis 526. The insertion end 528 of the cutter 510 is shown as threaded, and a nut 530 holds the cutter 510 in the desired condition. The resilient member 522 may be formed of compressible rubber or other elastomer, belleville springs, a coil spring, or other construction which will absorb the longitudinally-directed impact loads upon the cutter 510. The particular apparatus for locking the cutter in the socket may be any useful means, such as herein described.

Figure 28:
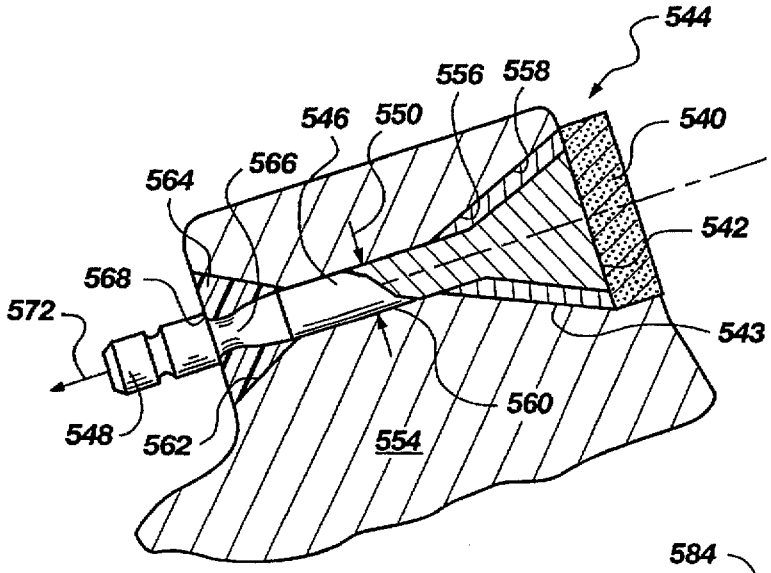
FIG. 28 is a cross-sectional side view of another form of the locking mechanism of the invention.

In FIGS. 28 through 31, additional means are illustrated for lockably mounting cutters in through holes in a drag bit. As shown in FIG. 28, a cutting element 540 is mounted on a support surface 542 of the cutting end 543 of an enlarged portion of cutter 544. The cutter 544 includes root 546 with an insertion end 548. Cylindrical root 546 has a reduced diameter 550 with respect to the cutting end 543. The enlarged cutting end 543 is preferably conical or cylindrical in shape, and may include an outer portion 552 of hard material.

The socket 556 in bit body 554 has an enlarged mouth 558 for accepting the cutting end 543 of the cutter 544, and has an axially aligned through hole 560 in which the root 546 is mounted. The socket 556 includes a generally conical portion or exit 562 configured to accept a split collar 564 in compression. The split collar surrounds a reduced diameter portion 566 of root 546. A shoulder 568 of the reduced diameter portion 566 retains the split collar 564 in compression against the conical socket portion 562 and prevents removal of the stud cutter 544 from the socket 556. The cutter 544 is installed by pulling insertion end 548 in axial direction 572 while forcing the split collar 564 into conical portion 562, seating the split collar 564 behind shoulder 568. The root 546 is thus locked and loaded in tension as mounted in the bit body 554. Friction between mating surfaces provides resistance against rotation or axial movement of the cutter 544. The cutter 544 may be easily removed by cutting out a portion of the split collar 564 to release the root 546.

Split collar 564 is formed of a resilient material such as a reinforced elastomer as shown, or may comprise a split metal collar of steel, nickel, stainless steel or beryllium copper alloys, or any other suitable material having a suitable modulus of elasticity.

Figure 29:
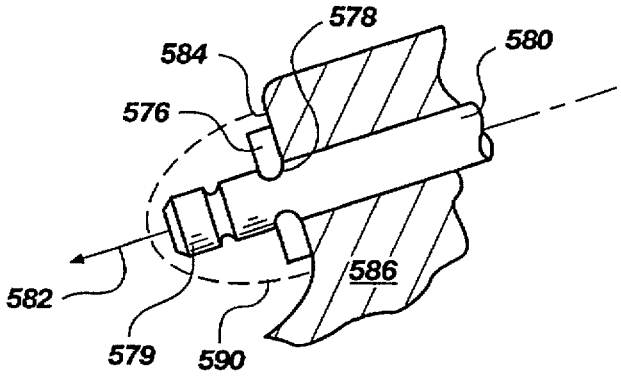
FIG. 29 is a cross-sectional side view of a further form of the locking mechanism of the invention.

FIG. 29 depicts another locking device configured to maintain the loading of a root of a cutter in tension. The cutting portion is not shown in the drawing. A horseshoe shaped retainer clip 576 formed of spring metal is expanded to slide into a partial or complete radial slot 578 on the periphery of root 580 of the stud cutter when the insertion end 579 of root 580 is loaded by axial tensile force 582. The clip 576 is retained against a wall 584 of bit body 586 to maintain the root 580 in a loaded condition, but may be easily removed to permit removal and replacement of the stud cutter. An erosion and abrasion-resistant cap, covering or coating may be applied as shown in broken lines at 590 may be applied to prevent deterioration of the locking device during drilling.

Figure 30:
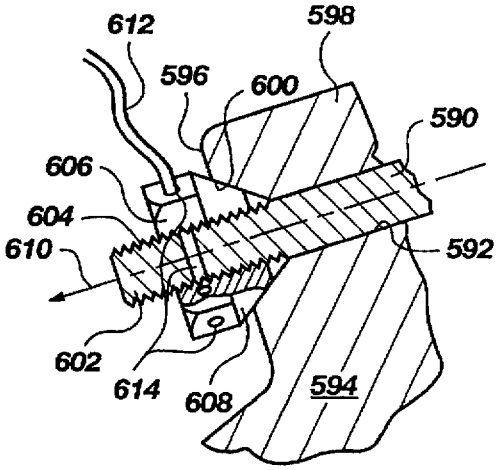
FIG. 30 is a cross-sectional side view of an additional embodiment of the locking mechanism of the invention.

Another form of a cutter locking device is shown in FIG. 30. The root portion 590 of a cutter is shown in through hole 592 of a bit body 594. The through hole 592 terminates in a conical portion 600 in rear face 596 of bit body extension 598. The insert end 602 of the root 590 has a threaded end portion 604. A threaded lug nut 606 has a conical contact face 608 which fits into conical depression 600, as it is screwed onto the root 590. The root 590 is drawn in an axial direction 610 relative to the bit body 594, to a tension-loaded state. A locking wire 612 is passed through corresponding holes 614 (the holes 614 being rotated toward each other in the drawing for clarity of illustration) in the nut 606 and root 590 to prevent movement therebetween. Thus, the cutter is locked into the bit body in a tension loaded condition. The locking wire may be easily removed and the lug nut unscrewed to release the stud cutter.

Figure 31:
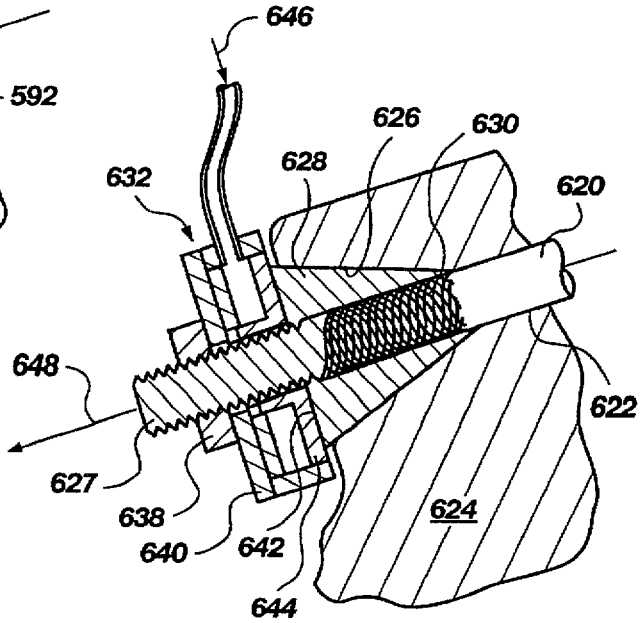
FIG. 31 is a cross-sectional side view of yet another embodiment of the locking mechanism of the invention.

FIG. 31 shows another embodiment of the invention. The root portion 620 of a cutter is mounted in a through hole 622 in bit body 624. The through hole 622 terminates in a conical portion 626 in which a split slip 628 is fitted. The root 620 has an insertion end 627 which is threaded. The root 620 has friction knurled or cross-hatched surface 630 where it contacts the surrounding split slip 628.

To lock the root 620 in split slip 628, the split slip is first installed to surround the root 620 in the conical portion 626. A compression device 632 is mounted on the root 620 and held by nut 638 and washer 640 against the end surface 642 of the split slip 628. Compression device 632 is shown as including a movable member 644 motivated by fluid pressure from source 646. Simultaneously, the split slip 628 is forced into the conical portion 626, and root 620 is drawn in axial direction 648 to load it with tensional force. The simultaneous actions lock the surface 630 to the slip 628 and maintain the tensile loading upon removal of the compression device 632. The nut 638 and washer 640 may then be tightened against the end surface 642 to ensure continued locking if desired. To remove the cutter, the split slip 628 may be simply cut to relieve the frictional grip of the split slip on the surface grooves 630.

As presented herein, a cutter according to the invention includes means for locking mounting in a socket within a drill bit. The cutter may be locked to prevent axial movement and/or rotational movement, yet provide for ready removal and replacement in the field. In another embodiment, means to permit a predetermined maximum amount of flexing is provided, to reduce the peak stress loads on the cutter elements and extend cutter life. Brazing of the stud cutter into the bit body is eliminated.

While the description of the preferred embodiments of the invention has focused on cutter structures and structures for mounting or installing same on bits, it will be appreciated that the mechanisms disclosed have equal utility for the mounting or installation of nozzle bodies or elements which are mounted in the bit to direct drilling fluid flow. The major general difference in cutter and nozzle structures being the existence of a fluid passage through a nozzle, all of those disclosed embodiments of cutters which are adaptable to having such a passage formed therethrough may be fabricated as nozzle structures. Inclusion of suitable abrasion- and erosion-resistant nozzle bore linings or fabrication of nozzle bodies in whole or in part of such materials is well within the skill of those practicing in the art, and need not be further described. It is contemplated that the mounting structures depicted in FIGS. 2–20 and described in their associated specification text are particularly adaptable to nozzle design and installation, although other embodiments may also be adapted thereto.

Reference herein to details of the described and illustrated embodiments of the invention is not intended to restrict the scope of the appended claims which themselves recite the features regarded as significant to the invention.

We claim:

1. A mounting structure for a cutting apparatus for an earth boring drill bit, comprising:

a stem having a longitudinal axis intersecting a cutting end and an insertion end;

a cutting element fixed to said cutting end;

a socket on said bit for receiving said stem; and locking structure for removably and replaceably locking and retaining said stem in said socket, said locking structure aligned at an angle to said longitudinal axis to prevent rotation of said stem.

2. A cutting apparatus for lockable attachment to an earth boring drill bit, comprising:

a stem having a longitudinal axis intersecting a cutting end and an insertion end, said stem having a radially sloped circumferential shoulder surface partially longitudinally extending between said cutting end and said insertion end, said shoulder surface circumscribing a major portion of the circumference of said stem and configured to intercept and abut a locking structure;

a cutting element fixed to said cutting end for projection from said drill bit; and a socket on said drill bit, said socket configured to accept said insertion end and including an arcuately undercut recess extending generally radially from said socket normal to said longitudinal axis and configured to intercept and abut said locking structure.

3. The cutting apparatus of claim 2, wherein said locking structure comprises a resilient split ring having an inside radially sloped surface, said split ring configured to be radially compressed for insertion and retentive expansion into said undercut recess; and wherein said stem radially expands said split ring to a loaded tensed locking condition of said sloped split ring surface in communication with said shoulder upon full insertion of said insertion end of said stem into said socket.

4. The cutting apparatus of claim 2, wherein said stem is circular in cross section.

5. The cutting apparatus of claim 3, wherein said split ring is circular in cross section.

6. The cutting apparatus of claim 3, wherein said split ring has an upward facing inside surface sloping upwardly toward the outer periphery and a downward facing inside surface sloping downwardly toward the outer periphery of said split ring.

7. The cutting apparatus of claim 6, wherein the slope of said downwardly facing inside surface of said split ring and the corresponding slope of said stem shoulder surface are arcuate, whereby the angle of contact therebetween relative said longitudinal axis decreases as said split ring is expanded by removal of said stem.

8. The cutting apparatus of claim 3, wherein said stem is generally conical about said longitudinal axis and said socket is correspondingly conical.

9. The cutting apparatus of claim 2, wherein:

said longitudinal axis is an axis of rotation and said circumferential shoulder surface circumscribes a plane offset from the normal to said axis;

said socket is configured to accept said insertion end and includes an arcuately undercut recess extending from said socket in said plane offset from the normal to said longitudinal axis of said inserted stud cutter;

said locking structure comprises a resilient split ring having an inside radially sloped surface, said split ring configured to be radially compressed for insertion and retentive expansion into said undercut recess; and said stem radially expands said split ring to a loaded tensed locking condition of said sloped split ring surface in communication with said shoulder upon full insertion of said insertion end of said stem into said socket, to lockably resist longitudinal and rotative movement of said stem within said socket.

10. The cutting apparatus of claim 9, wherein said offset is between about 1 and about 60 degrees.

11. A mounting structure for a cutting apparatus on an earth boring drill bit, comprising:

a generally truncated conical root with a longitudinal axis;

a cutting element fixedly mounted on the larger end of said conical root;

a friction weldable metal member attached to the smaller end of said conical root; and a socket on said drill bit, said socket having an upper sidewall surface and an enlarged lower radial space with a frictional surface for rotational frictional contact of said metal member thereagainst to soften and expand said metal member into said enlarged lower radial space and to lock said root into said socket via subsequent cooling and hardening of said metal member.

12. The mounting structure of claim 11, wherein said friction weldable metal member comprises one of aluminum, copper, or an alloy of either metal.

13. A mounting structure for cutting apparatus on a drag bit, comprising:

a stem having a longitudinal axis intersecting a cutting end and an insertion end, said stem including a locking surface adjacent said insertion end having hard radial projections thereon substantially transverse to the longitudinal axis;

a cutting element fixed to said cutting end of said stem;

a socket on said bit having a lower radial recess of enlarged diameter;

an annular element inserted in said lower radial recess, said element comprising material softer than said projections; and wherein said projections are frictionally held by said annular element to removably lock said stem in said socket.

14. The mounting structure of claim 13, further comprising a stop for limiting the insertion of said stem into said socket to a selected maximum depth.

15. The mounting structure of claim 13, wherein said projections comprise one of tungsten carbide, silicon carbide, a ceramic, or a ceramet and said annular element comprises one of soft steel, copper and aluminum.

16. A mounting structure for a cutting apparatus on an earth boring drill bit, comprising:

a truncated conical cutter body with a longitudinal central axis of rotation intersecting a cutting end and an insertion end;

a cutting element fixed to said cutting end for projection from the body of a drag bit;

helical threads formed on said conical cutter body adjacent said insertion end;

a truncated conical socket formed on said drill bit, said socket having an upper conical portion with helical screw threads adapted to receive said screw threads of said cutter body; and at least one keyway in each of said cutter body and said socket, said keyways cooperating to receive a key for lockably retaining said body within said socket in a non-rotatable position.

17. A mounting structure for a cutting apparatus on an earth boring drill bit, comprising:

an elongated cutter body having a longitudinal axis of rotation intersecting an enlarged cutting end and a reduced insertion end of said cutter body;

a helical screw thread formed on said cutter body adjacent said insertion end;

a cutting element fixedly mounted on said enlarged cutting end;

a socket on said drill bit, said socket having a bottom cylindrical bore of reduced diameter having helical screw thread in the upper portion thereof and adapted to receive said insertion end, said socket thread corresponding to said helical screw thread of said cutter body; and cooperating keyway structure in said cutter body and said socket, said keyway structure cooperating to receive a key for lockably retaining said cutter body within said socket in a non-rotatable, axially immobile position.

18. The mounting structure of claim 17, wherein said cutter body includes a truncated conical portion which is mounted in a truncated conical portion of said socket to maintain a portion of said cutter body in tension.

19. The mounting structure of claim 17, wherein said cutter body comprises:

a central, generally cylindrical core portion having an enlarged cutting end and an opposite, threaded insertion end; and an annular wall portion surrounding a portion of said cutting end of said core portion.

20. A mounting structure for a cutting apparatus for an earth boring drill bit, comprising:

a cutter body having a longitudinal axis of rotation intersecting a cutting end and an opposed threaded cylindrical insertion end of said stud cutter body;

a cutting element fixedly attached to said cutting end;

separable structure in the tip portion of said insertion end for separating said tip into a plurality of finger sectors swageable radially away from said longitudinal axis; and a socket on said drill bit, said socket having a lower threaded portion adapted to receive said threaded cylindrical insertion end of said cutter body, and including in the lowermost end a conically shaped slot diverging downwardly from said axis to form a conical socket base;

wherein upon screwing said cutter body into said socket, said finger sectors are swaged by said upwardly directed conical socket base into said slot to be separated and flared therein to lock said cutter body in said socket.

21. The mounting structure of claim 20, further comprising keyway structure adapted to accept a key between said cutter body and said bit to further lock said cutter body in said socket.

22. The mounting structure of claim 20, wherein said separable structure comprises at least one longitudinal slot passing through said central axis and dividing said tip into at least two outwardly swageable sector fingers.

23. A resilient cutting apparatus mounting structure for an earth boring drill bit, comprising:

an elongate compliant stem mounted on the body of a drill bit to project generally perpendicular to applied drilling forces, said stem having a central axis intersecting a cutting end and a mounting end;

a cutting element fixedly attached to said cutting end; and a stop mounted on a drill bit body member to contact said compliant stem during bending thereof, to limit said bending.

24. The mounting structure of claim 23, wherein said stem is removably replaceably mounted on said drill bit.

25. The mounting structure of claim 23, wherein a plurality of cutting elements are mounted on a single compliant stem.

26. A resilient mounting structure for cutting apparatus for an earth boring drill bit, comprising:

a cutter body having a longitudinal axis intersecting an enlarged cutting end and an opposed insertion end of smaller diameter in said cutter body;

a cutting member fixedly mounted on said cutting end;

a toroid of resilient material surrounding said insertion end adjacent said enlarged cutting end and aligned at an angle to said longitudinal axis to prevent rotation of said cutter body;

locking structure for locking said insertion end in a through socket formed in the body of a drag bit; and a socket on said drill bit, said socket having an enlarged portion for accepting said enlarged cutting end of said cutter body and said annulus therein, and a smaller diameter portion for passage of said insertion end therethrough.

27. The mounting structure of claim 26, wherein said locking structure is adapted to lock said cutter body in said socket with said resilient material in a compressed condition.

28. A mounting structure for a cutting apparatus for an earth boring drag bit, comprising:

a cutter body having an enlarged portion with a cutting end and a root of reduced diameter with an insertion end;

a cutting member fixedly mounted on said enlarged cutting end;

structure for removably locking said cutter body within a through socket; and a through socket in a drill bit, comprising an enlarged space for retaining said enlarged portion, and a through hole of reduced diameter having an exit on the surface of said bit, for passage of said insertion end therethrough and removably locking said stud cutter insertion end in tension.

29. The mounting structure of claim 28, wherein said insertion end of said root has a radial portion of reduced diameter, said through hole exit comprises an enlarged conical opening, and said structure for removably locking said cutter body within said through socket includes an elastomeric split collar compressionally fitting within said enlarged conical opening and surrounding said radial portion of reduced diameter to retain said root in tension within said through hole.

30. The mounting structure of claim 28, wherein said insertion end of said root includes a radial or radial partial slot, and said structure for removably locking said cutter body within said through socket includes a retainer clip having edges mountable in said slot under root tension.

31. The mounting structure of claim 28, wherein said through hole exit comprises a conical opening, said insertion end includes helical screw threads thereon, said structure for removably locking said cutter body within said through socket includes a threaded lug nut screwable onto said threaded insertion end, and said lug nut and insertion end including corresponding drill holes therethrough for insertion of a locking wire to lock said root in tension within said through hole.

32. The mounting structure of claim 28, wherein said root includes helical screw threads on said insertion end and surface friction grooves adjacent said screw threads, said exit comprising a conical opening, and said structure for removably locking said cutter body within said through socket comprising:

a split slip compressionally mounted in said conical opening and surrounding said surface friction grooves; and a compression device mountable on said root for simultaneously placing said root in tension and compressing said split slip into said conical opening; wherein said split slip is in frictional contact with said surface friction grooves and said root is in tension.

33. The mounting structure of claim 28, further including a structure covering said insertion end and said locking structure for protecting the engagement of said insertion end locking structure against abrasion or erosion during drilling with said bit.

* * * * *